US011174704B2

(12) United States Patent
Brandsdal

(10) Patent No.: US 11,174,704 B2
(45) **Date of Patent: *Nov. 16, 2021**

(54) INFLOW ASSEMBLY

(71) Applicant: VBT AS, Ytre Arna (NO)

(72) Inventor: Viggo Brandsdal, Ytre Arna (NO)

(73) Assignee: VBT AS, Ytre Arna (NO)

( * ) Notice: Subject to any disclaimer, the term of this patent is extended or adjusted under 35 U.S.C. 154(b) by 0 days.

This patent is subject to a terminal disclaimer.

(21) Appl. No.: 16/892,003

(22) Filed: Jun. 3, 2020

(65) Prior Publication Data

US 2020/0291747 A1 Sep. 17, 2020

Related U.S. Application Data

(63) Continuation of application No. 16/648,127, filed as application No. PCT/NO2018/050234 on Sep. 20, 2018.

(30) Foreign Application Priority Data

Sep. 21, 2017 (NO) ..... 20171515
Oct. 20, 2017 (NO) ..... 20171685

(51) Int. Cl.
*E21B 34/08* (2006.01)
*E21B 43/08* (2006.01)

(52) U.S. Cl.
CPC ..... *E21B 34/08* (2013.01); *E21B 43/08* (2013.01); *E21B 2200/04* (2020.05)

(58) Field of Classification Search
CPC ..... E21B 34/08; E21B 43/08; E21B 2200/04
See application file for complete search history.

(56) References Cited

U.S. PATENT DOCUMENTS 8,708,050 B2 * 4/2014 Dykstra ..... E21B 34/08 166/319
9,453,395 B2 * 9/2016 Fripp ..... E21B 43/12
(Continued)

FOREIGN PATENT DOCUMENTS

WO 02090714 A1 11/2002
WO 2014081306 A1 5/2014
(Continued)

OTHER PUBLICATIONS

International Search Report and Written Opinion issued in International Patent Application No. PCT/NO2018/050234 dated Nov. 12, 2018.

(Continued)

*Primary Examiner* — Matthew R Buck
(74) *Attorney, Agent, or Firm* — Arent Fox LLP

(57) ABSTRACT

An inflow assembly for use in a subterranean well, which inflow assembly is arranged to prevent one or more fractions of the produced medium from entering the production tubing, comprises at least one chamber containing within it at least three floating/sinking elements, the chamber having an inlet/opening facing in the inflow direction into the chamber, and having an outlet that is open to flow directly from the inlet/opening without being blocked by the floating/sinking element when a desired medium is produced, where the middle one of the elements is arranged to block the outlet aperture from the chamber when undesired medium is produced, whilst the two other elements have the task of forming a movable floor and a movable ceiling in the chamber.

5 Claims, 12 Drawing Sheets

(56) References Cited

U.S. PATENT DOCUMENTS

| | | | | |
|---|---|---|---|---|
| 10,822,920 | B2 * | 11/2020 | Killie | F16K 31/122 |
| 2004/0144544 | A1 * | 7/2004 | Freyer | E21B 43/08 166/369 |
| 2007/0246407 | A1 | 10/2007 | Richards et al. | |
| 2008/0041580 | A1 * | 2/2008 | Freyer | E21B 43/12 166/193 |
| 2008/0041581 | A1 * | 2/2008 | Richards | E21B 34/08 166/193 |
| 2008/0041582 | A1 * | 2/2008 | Saetre | E21B 34/08 166/205 |
| 2015/0308226 | A1 | 10/2015 | Killie et al. | |

FOREIGN PATENT DOCUMENTS

| | | | |
|---|---|---|---|
| WO | 2015009314 | A1 | 1/2015 |
| WO | 2015199545 | A1 | 12/2015 |
| WO | 2020040896 | A1 | 2/2020 |

OTHER PUBLICATIONS

British Search Report issued in British Application No. 2011390.8 dated Sep. 3, 2020.

* cited by examiner

INFLOW ASSEMBLY

CLAIM OF PRIORITY

This application is a Continuation of U.S. application Ser. No. 16/648,127, filed on Mar. 17, 2020, which is a 35 U.S.C. § 371 National Phase of PCT Application No. PCT/N02018/050234, filed on Sep. 20, 2018, which claims priority to Norwegian Patent Application No. 20171515, filed on Sep. 21, 2017, and Norwegian Patent Application No. 20171685, filed on Oct. 20, 2017, the disclosures of each of these applications are hereby incorporated by reference herein in their entirety.

BACKGROUND

The present invention relates to equipment used and operations performed in connection with a subterranean well, and, in embodiments described below, provides a more specific apparatus for automatic control of inflow from a subterranean formation into a tubular string located in the well.

When the proportion of formation water and/or gas produced from a well becomes excessive, the production must in many cases be stopped. Penetration of water or gas can vary along the well from one zone to another, and is dependent on reservoir permeability, pressure communication in the reservoir, coning and other non-homogeneities in the reservoir. Shutting off a zone that produces mostly water can however result in increased production from other zones in the well which produce mostly oil.

In recent years this knowledge has led to development of systems comprising surface-controlled valves and adjustable nozzles. Some of the disadvantages associated with systems of this kind are technical complexity and the need for complicated downhole equipment, thus resulting in poor operating reliability. Another drawback is that such systems usually cause a narrowing of the flow area of pipes located in the well.

Some well installations have the advantage of having a flow-restricting assembly in a well screen. Such flow restricting assemblies have, for example, been useful in preventing water coning, balancing production from long horizontal intervals etc. These flow-restricting assemblies are sometimes referred to as "inflow control devices."

In some proposed inflow control assemblies, the devices are arranged to counter frictional effects caused by fluid flow through the pipe. However, these units do not have the means to regulate the pressure drop across the system based on the water cut of the fluid. Before flowing into the pipe, the produced fluids must flow through a fixed flow restrictor such as a capillary tube or a nozzle, typically arranged around the pipe in the form of a helical wire. The fluid flows through tapering grooves formed by the wire. The disadvantage of this is that the system is dependent on the viscosity of the fluid and that the fluid viscosity can alter during production from the well. Such systems must also be tailor-made for each individual well as the form of the coil is dependent on the viscosity of the well fluid that it is desired to produce and the viscosity is different in different wells.

There is also a system including a viscosity-based coil of this kind that is machined directly in the housing of the inflow valve, which also provides the same restriction. Another drawback of viscosity-controlled inflow valves is that they will never close completely, when, for example, the water cut is large, they are more a restriction in the system.

Another proposed inflow control assembly is used when it is desired to produce gas from a well without simultaneous production of water. The unit is equipped with spherical, stacked, controlled buoyancy elements, each having a density less than water. When water flows in from the formation, the elements become buoyant and close one or more openings to prevent water from flowing into the pipe.

Another proposed inflow control assembly comprises a flow chamber attached to the pipe and provided with a plurality of floating bodies, each having a density approximately equal to that of the formation water. The chamber is formed with an inlet and surrounds nozzles that provide fluid connection between the pipe and the formation. When the inflow comprises a sufficient proportion of water, the floating bodies become buoyant and float from a position inside the chamber remote from the nozzles to a position that closes or covers the nozzles, thereby restricting inflow into the pipe.

The systems which today are based on floating bodies have weaknesses as the balls can float freely in the chamber, which, for example, during a halt in production in a well producing a certain amount of water, results in all the water in the pipe up to the surface falling slowly to the bottom and into the reservoir zone since water is heavier than both the produced gas and oil. During normal production, the balls will block the openings as intended as the water level rises, they will be held in place in the openings by the drop in pressure into the production tubing, which creates suction towards the opening blocked by the ball.

When there is a halt in production, the drop in pressure disappears at the same time as all the water in the production tubing falls back to the reservoir zone, which typically lies lowermost, all the balls will then disengage from the apertures they cover and float up to the top of the chamber. This will leave all underlying apertures open, since the balls float in water and they will now not be able to sink back down. When the well is started up again, there are two possible scenarios: (i) the well cannot be started up again because the hydrostatic pressure generated by the water is greater than the pore pressure in the well, which means that the water cannot be lifted out of the well; (ii) the well will produce undesirable amounts of water as all the apertures in the inflow valve are open, and since the whole well is filled with water it will take a very long time before the water will be produced out. In addition, there is a risk that the balls will be held by suction in the apertures that are open when the water level sinks, ultimately when all suspended water has been produced out, the end result will be a ball held by suction in each of the open apertures, which will limit the production to only a few exposed apertures, which causes the pressure drop that holds balls by suction in their apertures.

There are also systems that are based on viscosity and pressure drop where the liquid/gas flows in past a disc capable of moving a given distance in a bore. The disc has a larger diameter than the hole downstream, the liquid/gas flows towards the disc outside its diameter, in order then to flow between the disc and the bottom of the bore in towards an opening in the centre of the bore in which the disc is installed. Liquid with low friction and viscosity (oil) flows easily past the disc. Gas will create a drop in pressure between the disc and the bottom of the bore and the disc will be drawn by suction against the bottom so that it closes The disc will never be able to seal 100% as its function is dependent on there being a flow past the disc, it will therefore move constantly.

Several of the systems that are based on floating bodies are sensitive to the direction in which they are installed in the well. If a system of this kind is to be capable of working, it must be designed to function regardless of the way in which it ends up in the well, i.e., apertures that the buoyancy bodies are to close must be located appropriately so that the bodies block them when they float up. It is extremely difficult to control this when from two to several hundred inflow valves are to be installed in a well. The inflow valves are mounted on different sections of the production tubing, often one on each section. These sections are screwed together and, because of the threads on the production tubing, the valves will end up in different positions when the threads are tightened to the correct torque.

It is possible to index these threads so that they end up in the correct position. Indexing of the threads is, however, an extremely costly process and it must be done with all the threads in the tubing in order to have control of where the valves will ultimately end up in the well. If mistakes are made here and all the valves end up upside-down, it will, at worst, be impossible to produce anything from the well.

WO2014/081306A1 teaches an inflow assembly comprising a labyrinth of chambers and a plurality of floating/sinking bodies. The floating/sinking bodies will assume the correct position only if the inflow assembly is correctly oriented, i.e., is the right way in the vertical direction. In all other positions than the one correct orientation, the inflow assembly according to this publication will not function. It is difficult to ensure that an inflow assembly of this kind has the correct orientation when it is installed blindly several kilometres below the surface.

From the foregoing, it is evident that improvements are necessary in the field of automatic control of inflow into wells.

SUMMARY OF THE INVENTION

Through implementation of the principles according to the present invention, an assembly is provided that solves at least one of the aforementioned problems. An example is described below, where the flow of water, or alternating water and gas, together with produced oil is restricted. Another example is provided by the functions that are included to prevent outlets in the assembly from being plugged and the like.

According to a described embodiment, an assembly is provided to restrict the flow of undesired fluids from a subterranean formation into a tubular string that is located in a hydrocarbon-producing well. The assembly comprises a flow housing attached to the pipe string and which is adapted for communication with the outside (the formation side) of the tubular string and with the inside of the tubular production string via the flow housing. The flow housing has one or more inlets/outlets for the fluid and is provided with flow-blocking elements which, when the fluid does not contain mostly oil, are adapted to float from a position in the housing that allows production through the assembly to a position that closes, covers or in some other manner restricts the flow through the assembly.

Flow-blocking elements are preferably in the form of balls. If the undesired fluid is gas, the elements preferably have a density that is less than oil, such that the flow into the pipe string becomes increasingly shut off as the proportion of gas in it increases.

If the undesired fluid is water, the floating elements preferably have a density approximately equal to that of water. Alternatively, the floating elements can have a density that is less than that of water or greater than that of oil or gas (whichever of these is desired to be produced and has greatest density). As another alternative, some of the floating elements can have a density that is approximately equal to that of water, and some of the floating elements can have a density that is less than water.

The assembly with floating elements is arranged such that it is of no importance which way round it ends up in the well, it is equipped with one or more sets of floating elements. The floating elements are mounted in a chamber that restricts their movement. The sets of floating elements consist of, e.g., three floating elements where the different floating elements can have different density. In an embodiment, the middle floating element has a density that allows it to float in water; this element is positioned between the two other floating elements that sink in water.

The task of the two floating elements that do not float in water is to create a dynamic floating ceiling and floating floor in the floating element chamber such that the movement of the buoyant element is limited between these two elements. The two floating elements that sink in water have limited travel towards the centre of the total travel length in the chamber, this limitation is adjusted so as to allow the floating element positioned in the middle to float up in the chamber until it comes to a stop against one of the sinking floating elements.

If the outlet is placed in the centre of the total travel length of the three elements in the chamber, it will be seen, in a situation in which oil is produced, that one of the floating elements that sink in water lies on the floor of the chamber, the middle element that sinks in oil lies on top of that element and the uppermost element that sinks in water abuts against a travel stop towards the centre of the chamber. In such a situation, the opening out from this chamber will be open and oil can flow freely through the assembly. Owing to the circular form of the structure where the chamber/chambers are mounted radially around the radius of the production tubing, it will be seen that in a situation where the chamber ends up in any position radial to the cross-section of the production tubing, this will be the case, i.e., the balls sink down and the openings are free for passage.

The exception is straight up and down. It is therefore desirable to place more than one chamber around the circular section of the production tubing so as to prevent the chamber from ending up at the top of the pipe where it will then only close when 100% water is produced.

At the same time, it is disadvantageous to place the chamber at the bottom of the pipe, as this would then result in a permanently closed function. It may therefore be advantageous to distribute the chamber evenly around the radius of the pipe so that a gradual closing off is obtained. In a situation where water flows into the chamber, the two floating elements that sink in water remain where they are and the middle element will float up until it hits the ceiling of the chamber that is formed by one of the two other floating elements. When it hits the ceiling, it will be sucked in towards the outlet aperture in this chamber and block it. If the water continues to rise, the process will be repeated as the water rises and close more and more of the outlets from the chambers.

In connection with closing off of gas, the density of the floating elements will have to be changed such that all float in oil where this is the preferred production fluid. The unit will then close from top to bottom because all the floating elements float in oil. When the gas enters, they will sink. They then causing closing when the middle floating element passes the outlet aperture from the respective chamber.

To reduce the flow from different zones of the formation that potentially produce an excessively large proportion of gas or water, more than one inflow assembly can be installed at relatively short intervals along the tubing. Combinations of water-blocking inflow assemblies and gas-blocking inflow assemblies can be installed. Furthermore, water can be blocked from falling back into the well zone in the event of a halt in production by mounting a water-stopping assembly with reversed configuration such that it stops water from penetrating into the reservoir zone. This will, when the water sinks back down in the production tubing during a production shutdown, prevent water from flowing back through the inflow valve. At the same time, oil from the reservoir zone will, when production is started up again, be able to flow freely past the inflow assembly which now is full of oil and not water. The unit with reversed flow direction will not be able to hold back the oil that flows out of the inflow assembly as the floating elements are not capable of holding back the oil when they are pressed off the apertures they block. Since these assemblies operate independent of each other and with immediate response, greater selectivity and better control are achieved.

In embodiments of the inflow assembly based on floating elements having a spherical form, it is a problem that the balls are held by suction in the outlet apertures and do not disengage from them if the undesired production diminishes. For instance, this can happen in connection with ebb and flow conditions in the reservoir where, for example, the water surface in the reservoir changes. In such situations, the inflow assembly based on density differences and floating elements will remain closed as the pressure drop/suction from the production holds the floating elements in place over the apertures.

In the described embodiment, the density of the ceiling ball can be exactly that required for it to sink in water. If then end stops/travel limiters on the two outermost floating elements are positioned such that the floating element in the middle must lift the ceiling element slightly in order to block the outlet aperture, a situation will arise where, when there is water in the system, a lift from the middle element must be provided to close the outlet. When the oil then returns, the ceiling element that sinks in oil will put an increased pressure on the middle element such that suction from the pressure drop is overcome and the middle element disengages from the outlet aperture more readily also during production.

The inflow assembly can also advantageously be equipped with one or more outlet apertures that pass outside sets of inflow restrictors/floating elements. This is to ensure that a regular small flow of oil or gas does not ultimately fill the inflow assembly with undesired production and thus prevent production of the desired fluid as a result of a small production of an undesired production fraction from the well, such as gas or water. One or more such outlet apertures can be arranged to allow through a given amount of undesired production fraction, for example, it may be acceptable to produce 20% water from a zone, but not more. Then the inflow assembly will at any given time allow up to 20% water through the outlet, whilst during production of larger amounts of water it will be filled and close off the respective zone, such that it is only water from the bypass aperture that is produced. The bypass aperture can also be equipped with a flow restrictor that becomes active when there is 100% production of water through it in order thus to further close the bypass. This can be done, for example, by a pressure-controlled device that reacts to flow rate, or a viscosity-controlled device.

Thus, an inflow assembly is provided for use in a well in which fluid is produced which includes both oil and gas. The inflow assembly comprises several flow-blocking elements, where by means of variation in the density of the floating elements it is possible to close off gas or water almost 100% down to a desired maximum level for the undesired production fractions from the well. The floating elements are placed in one or more chambers such that the elements increasingly restrict a flow of water or gas out of the chamber through one or more outlets.

Also provided is an assembly for limiting production of at least one undesired fluid from a well, the undesired fluid having a density that is different to the density of a desired fluid. The assembly comprises at least a flow restrictor and at least a temporary flow restrictor, which has the task of preventing the chambers from slowly being filled with an undesired production fraction that leads to permanent 100% closure.

The assembly further comprises several sets of floating elements. The floating elements operate to increasingly limit the amount of undesired fluid through the flow restrictor in response to an increased proportion of the undesired production fractions.

These and other features, advantages, and objects of the present invention will be obvious to a person skilled in the art on careful consideration of the detailed description of representative embodiments of the invention in the following description thereof.

DETAILED DESCRIPTION

It should be understood that the different embodiments of the present invention described herein can be used in different orientations, such as sloping, inverted, horizontal, vertical etc., and in different configurations without departing from the principles of the present invention. The embodiments are only described as examples of useful applications of the principles of the invention, which are not limited to any specific details of these embodiments.

In the following description of the representative preferred embodiments of the invention, directional terms such as "above", "below", "upper", "lower" etc. are used to make it easier to refer to the attached drawings.

The embodiments described below comprise an assembly that automatically controls the flow from a subterranean formation into a tubular string located in a hydrocarbon-producing well. Although the drawings illustrate a tubular string oriented in a horizontal direction, it will be appreciated that the invention relates also to tubular strings oriented in a vertical direction, as well as in any other direction.

Figure 1:
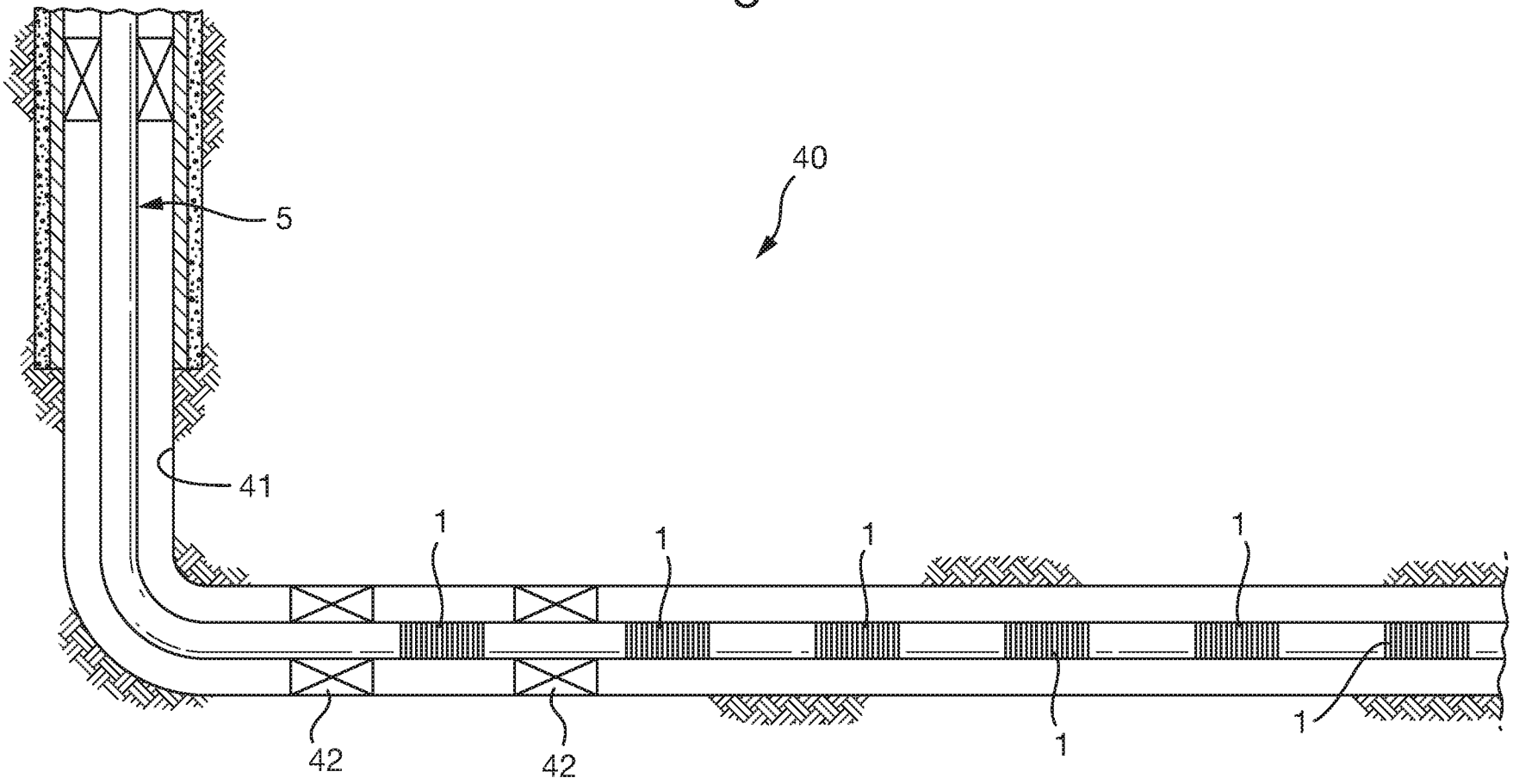
FIG. 1 is a schematic partial cross-sectional view of a well system showing the principles of the present invention.

A possible embodiment of the invention is illustrated in FIG. 1, which shows a well system 40, where a tubular string 5 (which is a production string) is installed in a borehole 41 in a well. The tubular string 5 comprises several well screens 1 positioned along a generally horizontal portion of the borehole 41.

One or more of the well screens 1 can be placed in an isolated part of the wellbore 41, for example, between the packers 42 installed in the wellbore. In addition or alternatively, many of the well screens 1 can be placed in a long, continuous part of the wellbore 41 without the packers isolating the borehole between the screens.

Gravel packs can be provided around some or all of the well screens 1 as required and desired. Other well equipment (such as valves, sensors, pumps, control and maneuvering devices etc.) can also be provided in the well system 40.

It should be understood that the well system 40 is only an example of a well system where the principles of the invention can be used in an advantageous manner. However, the invention is not limited to the details of the well system 40 described herein. For example, the screen 1 can instead be positioned in an anchored and perforated portion of a borehole, as the screens can be used in a generally vertical portion of a borehole, the screens can be used in an injection well rather than in a production well, etc.

As described in more detail below, the screens 1 are a part of an inflow control assembly 20. However, it should be understood that it is not necessary for the inflow control assembly 20 to include a screen 1, since an inflow control assembly can be used alone without a screen, if so desired.

Each inflow assembly 20 is adjusted by selecting correct density of the floating elements 6 and 7, in order variably to restrict the flow from an adjacent zone into the tubular string 5. When the zone in question that is associated with a specific inflow assembly 20 produces a larger proportion of an undesired fluid (such as water, or sometimes gas), the inflow assembly 20 will increasingly restrict the flow from this zone. Thus, the other zones that produce a larger proportion of desired fluid (such as oil) will contribute more to the production via the tubular string 5. Since there will be a larger drop in pressure from the formation to the tubular string 5, owing to the fact that a zone has been closed off, this will in turn result in a larger production of desired fluid.

Figure 2:
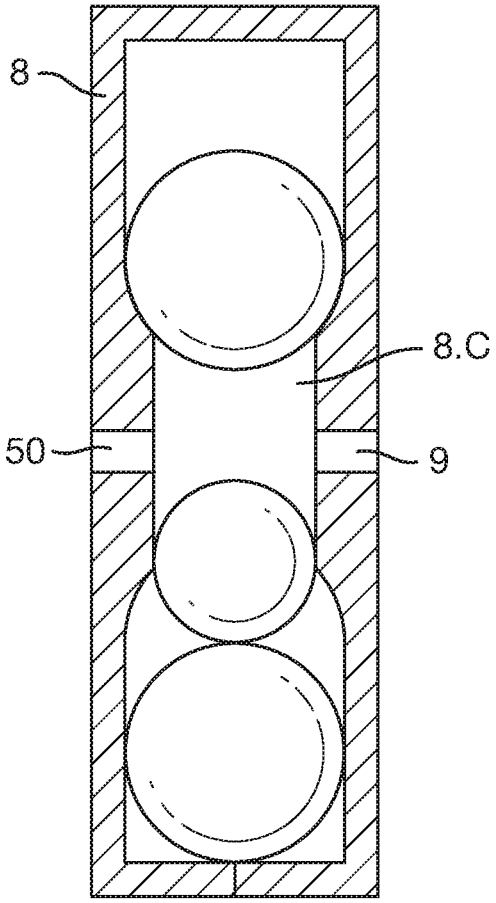
FIG. 2 is a schematic cross-section of an apparatus showing the principles according to the invention with the valve open, which can be used in the well system in FIG. 1.

A possible embodiment illustrated in FIG. 2 shows the housing 8 of the inflow assembly 20 in simplified form with three floating elements 6.1, 6.2 and 7, preferably balls, but other forms of floating elements can also be used, installed in a simplified housing 8*b*. The housing is filled with a light oil having a lower density than water, and it can be seen that all three floating elements lie at the bottom of the chamber 8*c* that is formed in the housing 8*b*. Floating elements 6.1 and 6.2 have a density that causes them to sink in water whilst element 7 floats in water and sinks in light oil. For example, element 7 may have a density of 0.93 so that it sinks in oil. It can be seen that element 6.2 stops against the floor of chamber 8*c* and that floating element 7 lies on top of floating element 6.2 as both sink in the oil that is present in the chamber which, for example, can have a density of 0.8. It can be seen further that floating element 6.1 stops against a stop 6.*a* in the chamber 8*c*. This leaves the inflow assembly 20 open for throughflow as aperture 9*b* in the chamber 8*c* is open. The distance between bottom and top of chamber 8*c* is adjusted such that floating element 6.2 has exactly room for element 7 on top of it when aperture 9*b* is open, that is, at both elements sink because a light, desired production fluid is present in the housing 8*b* and chamber 8*c*.

If the simplified housing 8*b* is inverted, all the floating elements 6.1, 6.2 and 7 will move to the opposite end of chamber 8*c* and the valve will still be open. If the housing 8*b* and chamber 8*c* are made curved so that they fit into the diameter of the housing 8 in the inflow assembly 20, it will be possible to turn this housing 8 around 360 degrees, and it will be capable of functioning as intended in all positions with the exception of straight down which will always be closed. Thus, the housing 8 and chamber 8.*c* are not dependent on the installation direction/orientation in the well, and there is no need for any form of indexing during and/or after installation in the well.

Figure 3:
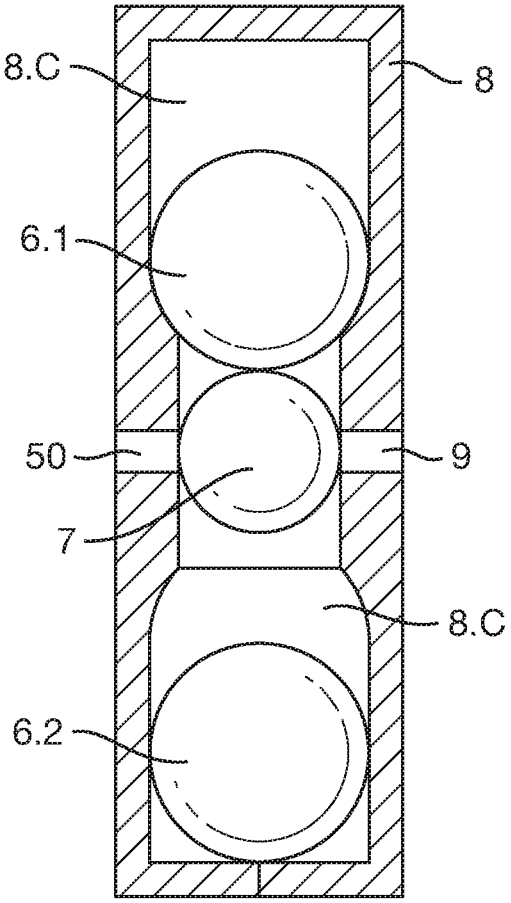
FIG. 3 is a schematic cross-section of an apparatus showing the principles according to the invention with the valve closed, which can be used in the well system in FIG. 1.

A possible embodiment illustrated in FIG. 3 shows the situation in a chamber when an undesired fluid, for example, water, enters and causes element 7 to float up. It can be seen that element 7 floats up and closes outlet 9*b*, as element 6.1 prevents floating element 7 from moving too high or passing outlet 9*b* as it forms a movable ceiling in the chamber 8*c*. This ceiling will alternate between element 6.1 and 6.2 depending on the position of chamber 8*c* in the well. In one position, element 6.1 will form the ceiling and in another position element 6.2 will form the ceiling.

The weight of floating elements 6.1 and 6.2 can also be adjusted such that when desired fluid is present, they exert downward pressure on element 7. To achieve this, stops 6.*a* and 6.*b* must also be adjusted a little in towards the centre of chamber 8*c*. To obtain full closure of outlet 9.*b*, element 7 must then lift either element 6.1 or 6.2 slightly up from its stop. With correct weight adjustment of elements 6.1 and 6.2, this will only be able to happen when the undesired fluid rises to the respective element. Then the lifting force from the fluid combined with lift from element 7 will be able to lift the ceiling that is formed alternately by elements 6.1 and 6.2, depending on the position up from their stop 6.*a* or 6.*b* such that element 7 is held by suction in the outlet aperture 9*b*.

In the inflow control assembly 20, there will always be suction downstream from the housing 8 and the chambers 8.*c* because of the drop in pressure created by the producing zones. This suction will suck the elements 7 in place in the apertures 9 when an undesired fluid is present. During normal production, elements 7 will therefore not be removable from the apertures 9 and production from closed-off zones will therefore not be capable of being started up again even if desired fluid were to enter the respective zone. If there is an arrangement as described above, where element 6.1 or 6.2 exerts a downward pressure against element 7 when light fluid is present, this will push element 7 away from aperture 9. This will happen when the total downward-acting pressure from element 6.1 or 6.2, combined with downward-acting pressure from element 7, which also sinks in desired fluid, is greater than the suction from the production. Thus, the production from closed zones will be capable of being started up again automatically should desired fluid return to the zone.

Figure 4:
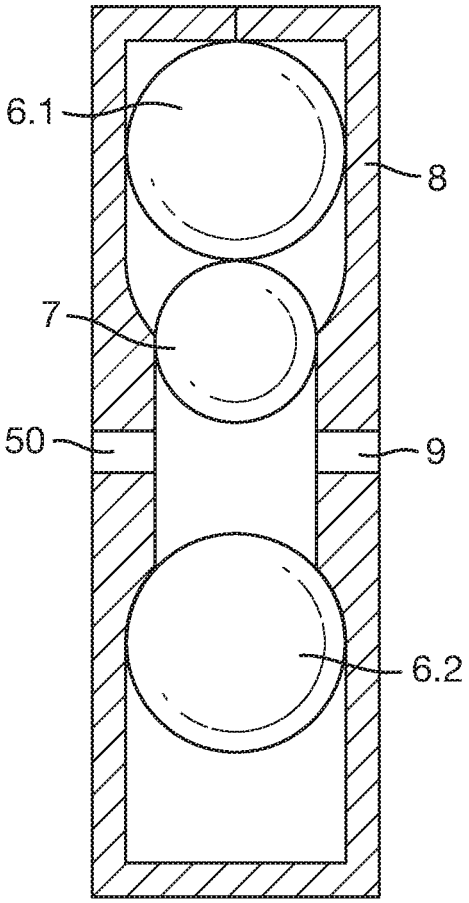
FIG. 4 is a schematic cross-section of an alternative configuration of the apparatus, with balls having reduced density for closing off gas, and where the valve is shown open.

An advantageous embodiment is illustrated in FIG. 4 and shows a configuration where all the floating elements 6.1, 6.2 and 7 float in desired production fluid. When gas enters in this version, all the elements will sink. Gas is lightest so the floating element 6.1 sinks first and exerts a downward pressure against floating element 7. When the gas is at a level that causes the floating element 7 to sink, the floating element 6.1 and the floating element 7 will gradually sink down to outlet 9 and block it. Full blocking occurs when also the floating element 6.2 sees sufficient gas to sink. When the desired heavy fluid then returns, the elements will float up again and lift the floating elements 6.2 and 7 and overcome the suction from the production that holds the floating element 7 in front of the aperture 9, thereby opening it for throughflow.

By selecting an average density, preferably from 600 kg/m^3 to 800 kg/m^3, and by remembering that the density of the oil is typically somewhat less than 900 kg/m^3, the elements 7, 6.1, 6.2 will be in a floating or "freely floating" state as long as the gas potentially included in the fluid does not lower the total density to below the selected sub-density. On the other hand, if the flow of gas results in a total density of the fluid that is about equal to the density of the element, the elements 7, 6.1, 6.2 will have "neutral buoyancy" and will sink down in chamber 8.*c* and be drawn to outlet apertures 9 due to the drop in pressure across them. The respective outlet aperture 9 will then be blocked by element 7.

The density of the elements 7, 6.1, 6.2 is preferably between the oil density and the density of gas. If the oil and the gas are separated in the chamber 8.*c* (i.e., with lower density gas above the oil of higher density), the elements 7 will be positioned at the interface between the oil and the gas.

When the interface drops down in the chamber 8.*c* (that is, an increasing proportion of gas in the chamber), an increasing number of outlet apertures 9 will be blocked by the elements 7. When the interface rises in the chamber 8.*c* (that is, an increasing proportion of oil in the chamber), a diminishing number of outlet apertures 9 will be blocked by the elements 7.

Thus, the inflow assembly 20 provides several advantages. When the proportion of gas increases, the restriction of the flow of the fluid through the inflow assembly 20 also increases. Furthermore, the elements 7 block the uppermost outlet apertures 9 that are more exposed to the gas in the chambers 8.*c*. Ultimately, all the outlet apertures 9 in the inflow assembly 20 will be closed, thereby obtaining a larger drop in pressure across the inlet assembly 20, the drop in pressure thus increasing across other zones in the well which in turn leads to greater production from oil-producing zones, and thereby allowing a greater production of oil from other zones to flow into the tubular string 5.

Figure 9:
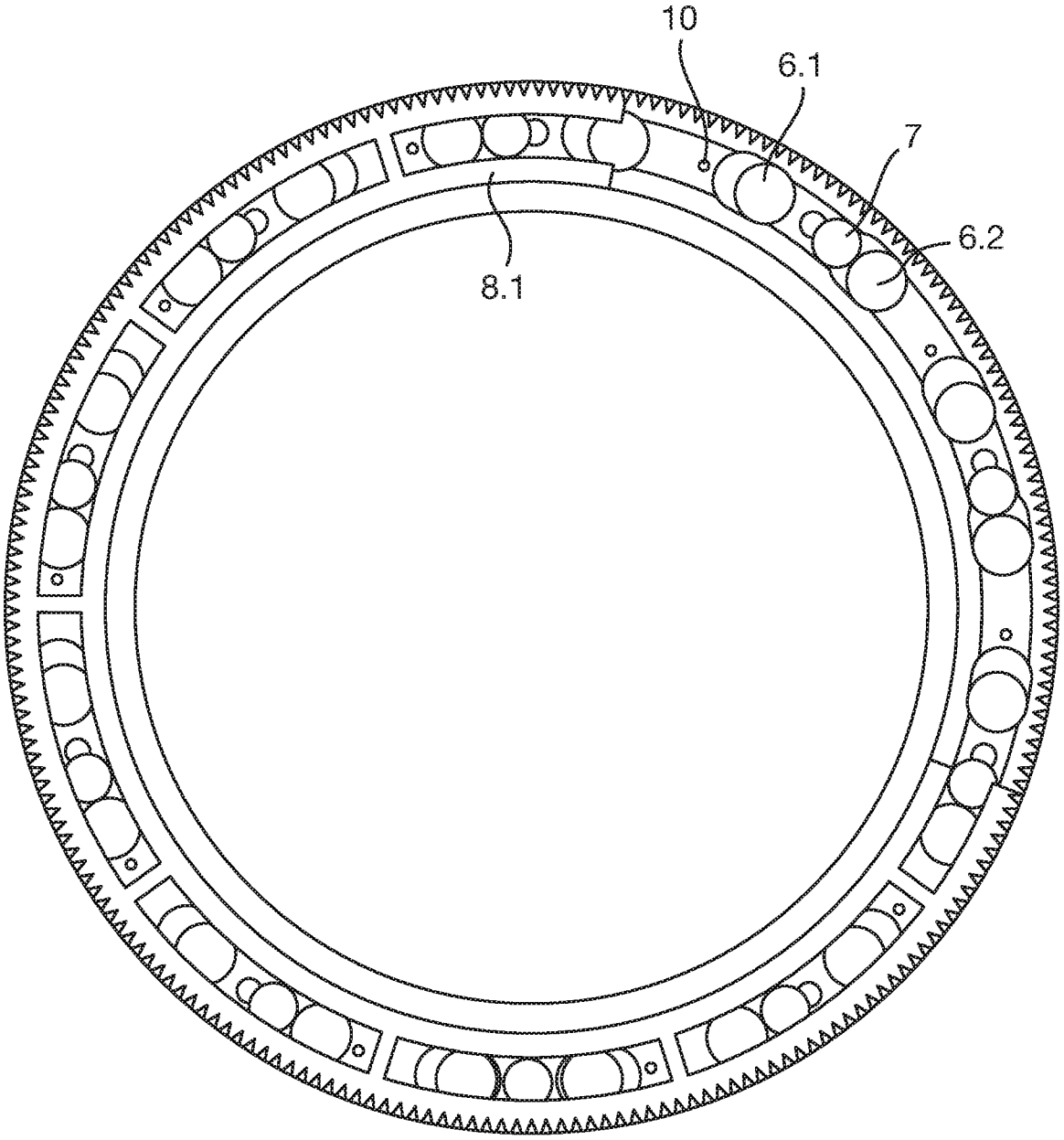
FIG. 9 is a schematic cross-section of the inflow assembly 20, which shows the principles according to the invention seen from the screen 1 end, and where the valve is open. Part 8.1 from the housing has been partly removed in order better to show floating elements 7 and 8. Production aperture 9 and bypass aperture 10 are also shown.

There may be cases where a complete shutting off of production is undesirable, regardless of how great a proportion of gas is in the fluid. Optional bypass outlets 10 as shown in FIG. 9 can be used to provide communication between the interior of the housing 8 and the inner part of the production chamber 8.*c* or directly into the tubular string 5, thereby allowing some production at all times, even if the elements 7 may have closed off or choked flow through the remaining outlet apertures 9 (as in cases where there are large amounts of gas in the fluid).

Figure 5:
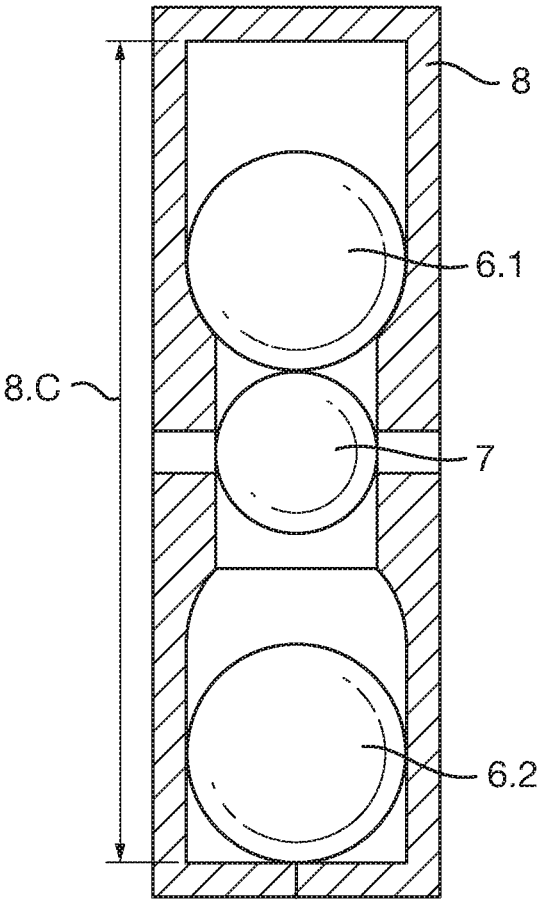
FIG. 5 is a schematic cross-section of an alternative configuration of the apparatus, with balls having reduced density for closing off gas, and where the valve is shown closed.

FIG. 5 shows a gas version in closed state with floating elements 6.1, and 7 in sunken position whilst the floating element 6.2 has only partly sunk since the lower part of the chamber is filled with desired fluid.

Figure 6:
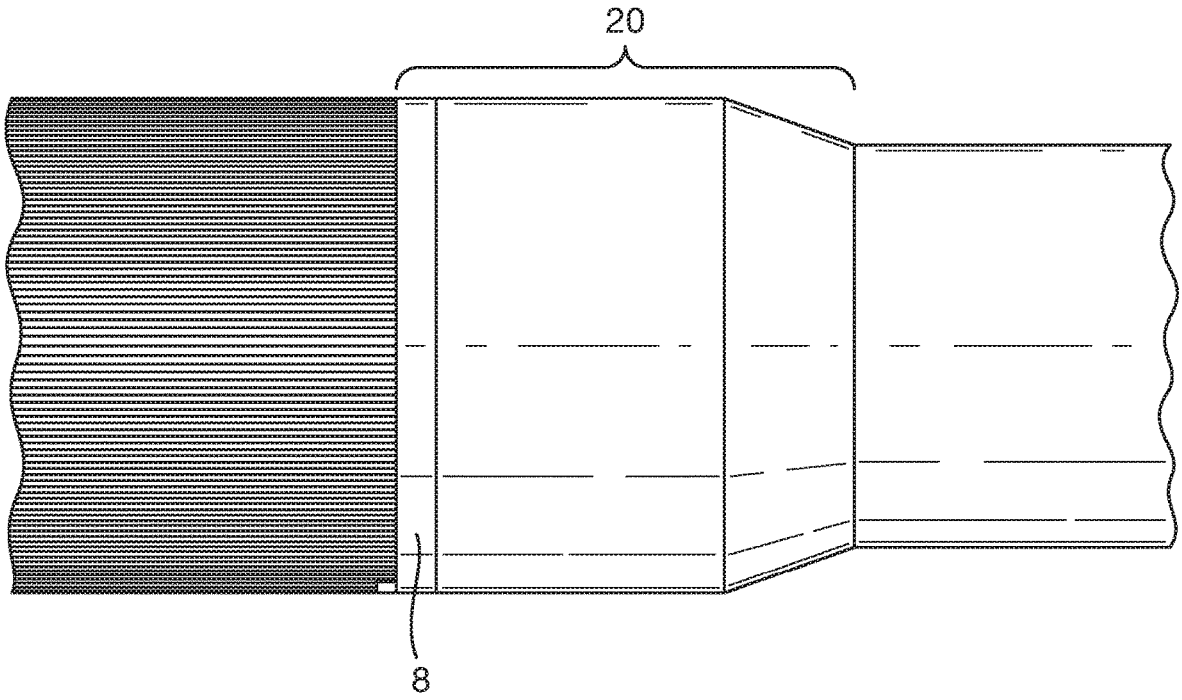
FIG. 6 shows the inflow assembly 20 mounted together with a screen 1 on a tubular string 5

FIG. 6 shows the inflow control assembly 20 mounted at the end of a screen 1.

Figure 7:
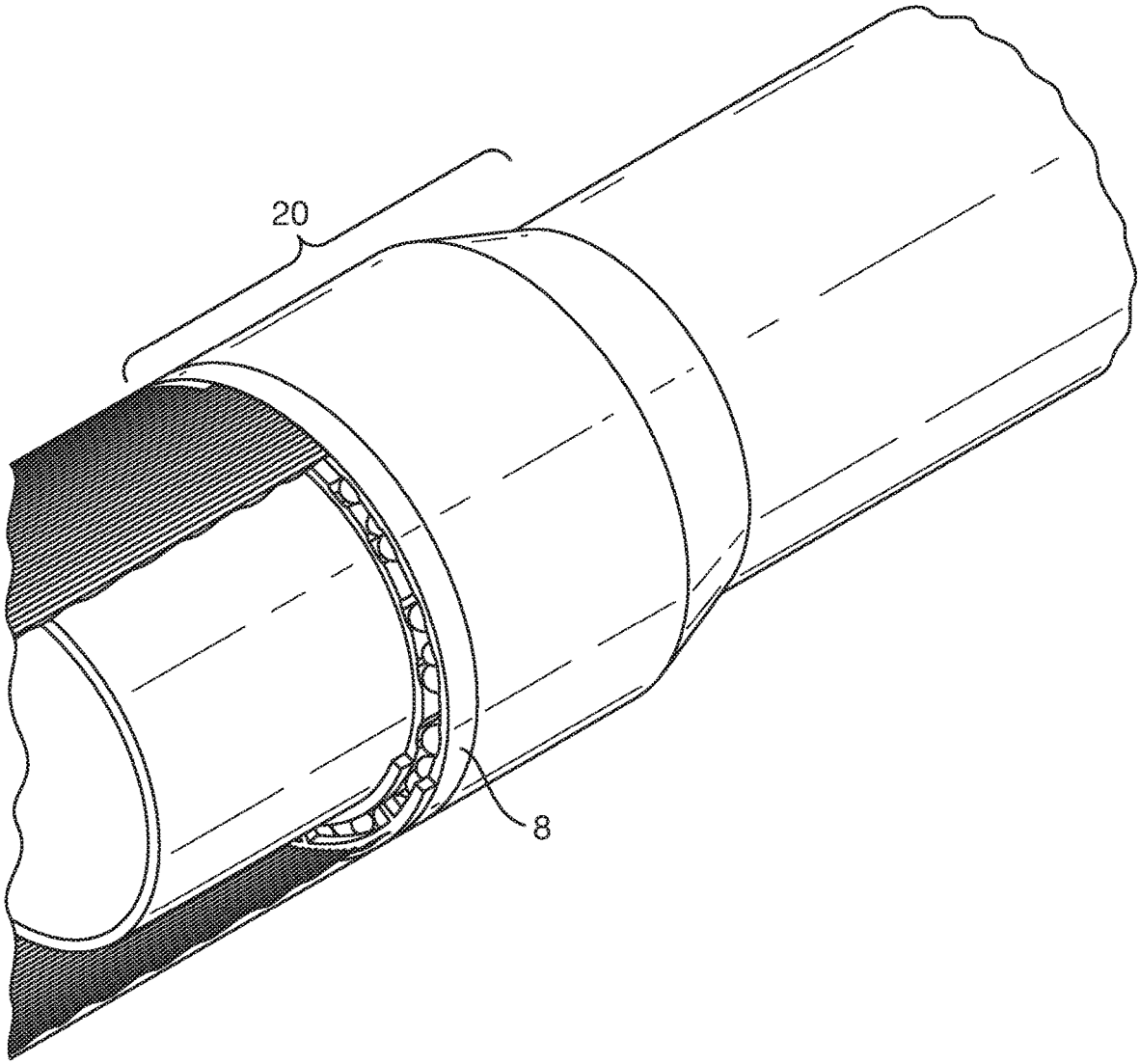
FIG. 7 is a schematic perspective view of the inflow assembly 20, which shows the floating elements 6 and 7 mounted in the housing 8, a part of the housing 8 and screen 1 having been removed.

FIG. 7 shows the inflow control assembly 20 mounted at the end of a screen 1, and here the inflow control assembly 20 is partly cut away. Visible inside the housing 8 are the, in this case, curved chambers 8 and the floating elements 6 and 7.

Figure 8:
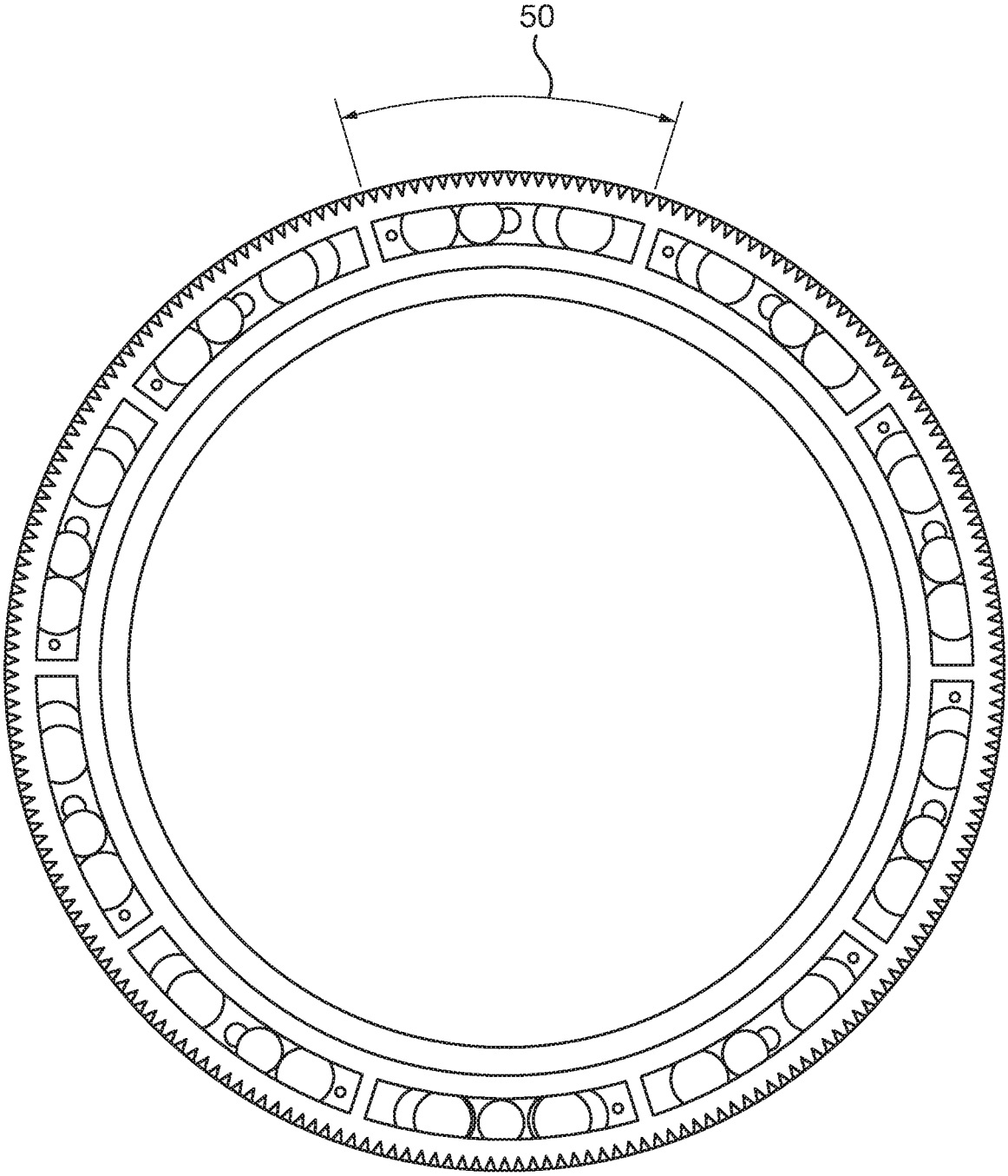
FIG. 8 is a schematic cross-section of the inflow assembly 20, which shows the principles according to the invention seen from the screen 1 end, and where the valve is open.

FIG. 8 is a view from the screen end and shows that the flow outlet aperture 9 in the inflow control assembly 20 is fully open straight in towards the screen. This is achieved in that all the floating elements are in a desired production fluid and thus are in a sunken position. The flow will therefore be axial between the screen 1 and the tubular string 5 through the flow outlet 9.

The axial flow is achieved in that chamber 8*c* is fully exposed to the screen/reservoir side through large openings in the housing 8, which in this case are formed by grooves in the rear wall 8.1 of the housing 8.

Figure 13:
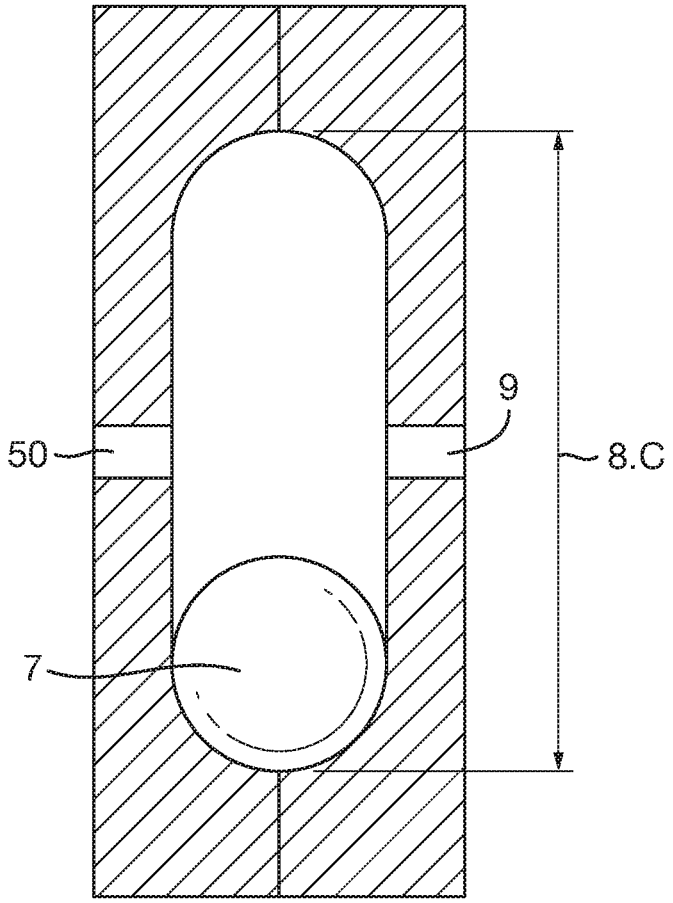
FIG. 13 shows a section of an embodiment having just one floating element.

This constitutes a further advantage compared with other versions as there is no need to flow the well production into a chamber in which the floating elements are situated in order then to flow the production past the floating elements. In a situation where the flow from the well must flow past the floating elements in order then to flow out through apertures 9, there could be a risk of apertures 9 being closed because the flow rate past the floating elements will constitute a lift of them. A configuration of this kind will also be advantageous in a simplified version as illustrated in FIG. 13 where there is only one floating element 7.

It will then be possible to flow fluid through the inflow control assembly 20 past element 7 without running the risk of lifting it up to the flow outlet 9. A simplified version of this kind can be advantageous in some cases where the density of the desired and undesired fluid is high.

FIG. 9 shows an inflow assembly 20 seen in side view also with the rear wall 8.1 of housing 8 partly cut away to provide a better view of the chamber 8.*c*. Stops in chamber 8.*c*, 6.*a* and 6.*b* are also visible here. Also shown here are bypass apertures 10. Bypass apertures 10 are present in order always to allow a certain minimum production through the inflow assembly 20. This is because it would otherwise fill up slowly with undesired production and thus close permanently.

If a little production is always allowed through, this guarantees that a little production of undesired medium does not close off the inflow assembly 20 permanently.

The number of sets of chambers 8.*c* and floating elements 6 and 7 are only illustrative and can be from two to infinity. One will of course not be sufficient to guarantee full independence from the direction of the installation, but one may be appropriate in some cases where the direction of the installation is not critical.

Figure 10:
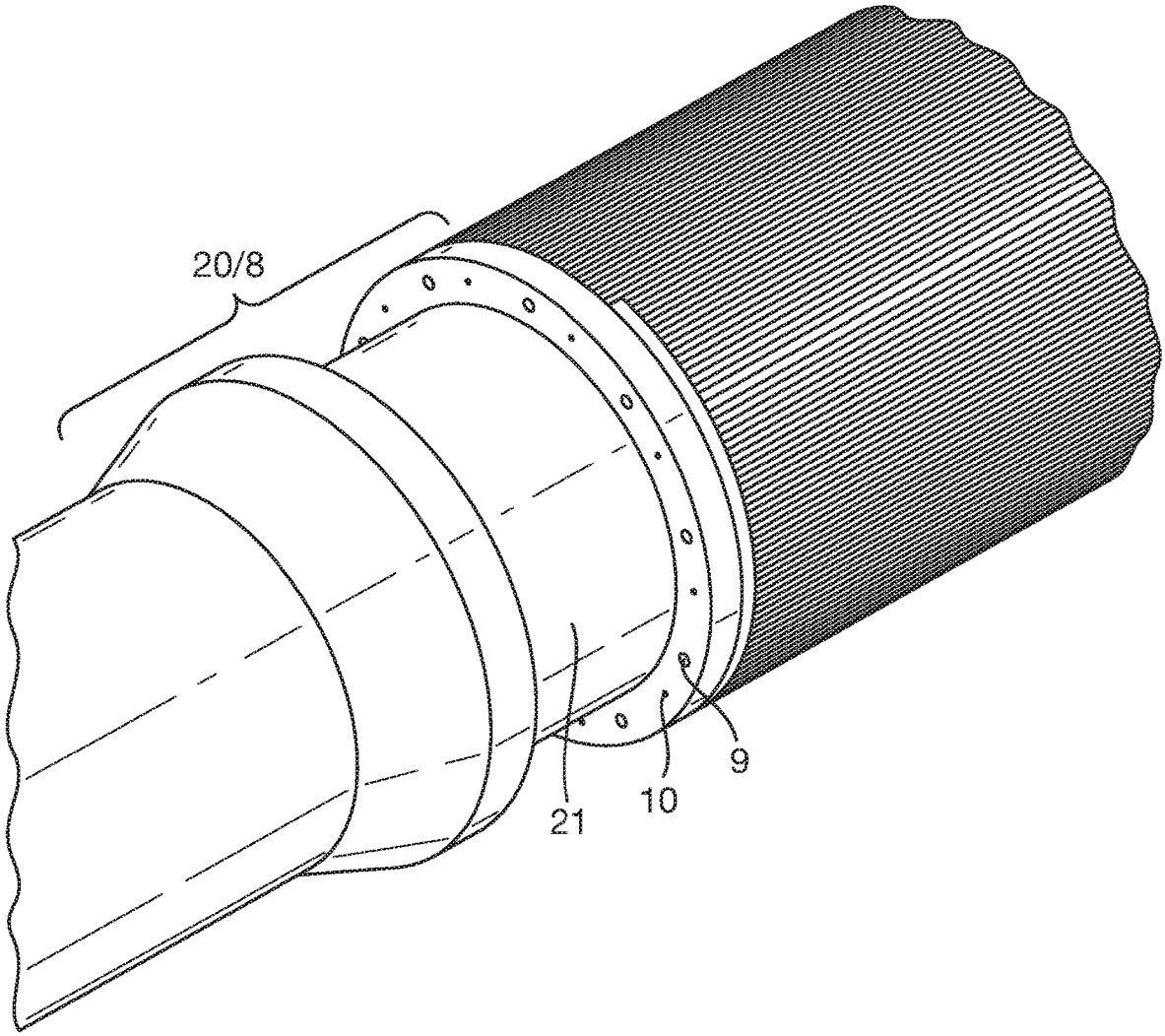
FIG. 10 is a schematic partly cutaway perspective view of an inflow assembly 20, which shows the outlet end from the inflow assembly 20 into production chamber 21, where the wall in production chamber 21 has been partly removed.

FIG. 10 shows the inflow assembly 20 in a partly cutaway view from the outlet end in through a production chamber 21. A production chamber 21 of this kind is not essential as in some cases it may be desirable that outlet apertures 9 from chamber 8.*c* pass directly into the tubular string 5. This can, for example, be desirable if an increased suction against the aperture 9 is required. In order to increase such suction, it is also possible to allow aperture 9 to pass through a long channel or a pipe before it runs into the tubular string. By allowing the fluid to enter a production chamber 21, the drop in pressure is reduced and element 7 will more easily disengage from aperture 9 on the return of desired medium.

Figure 11:
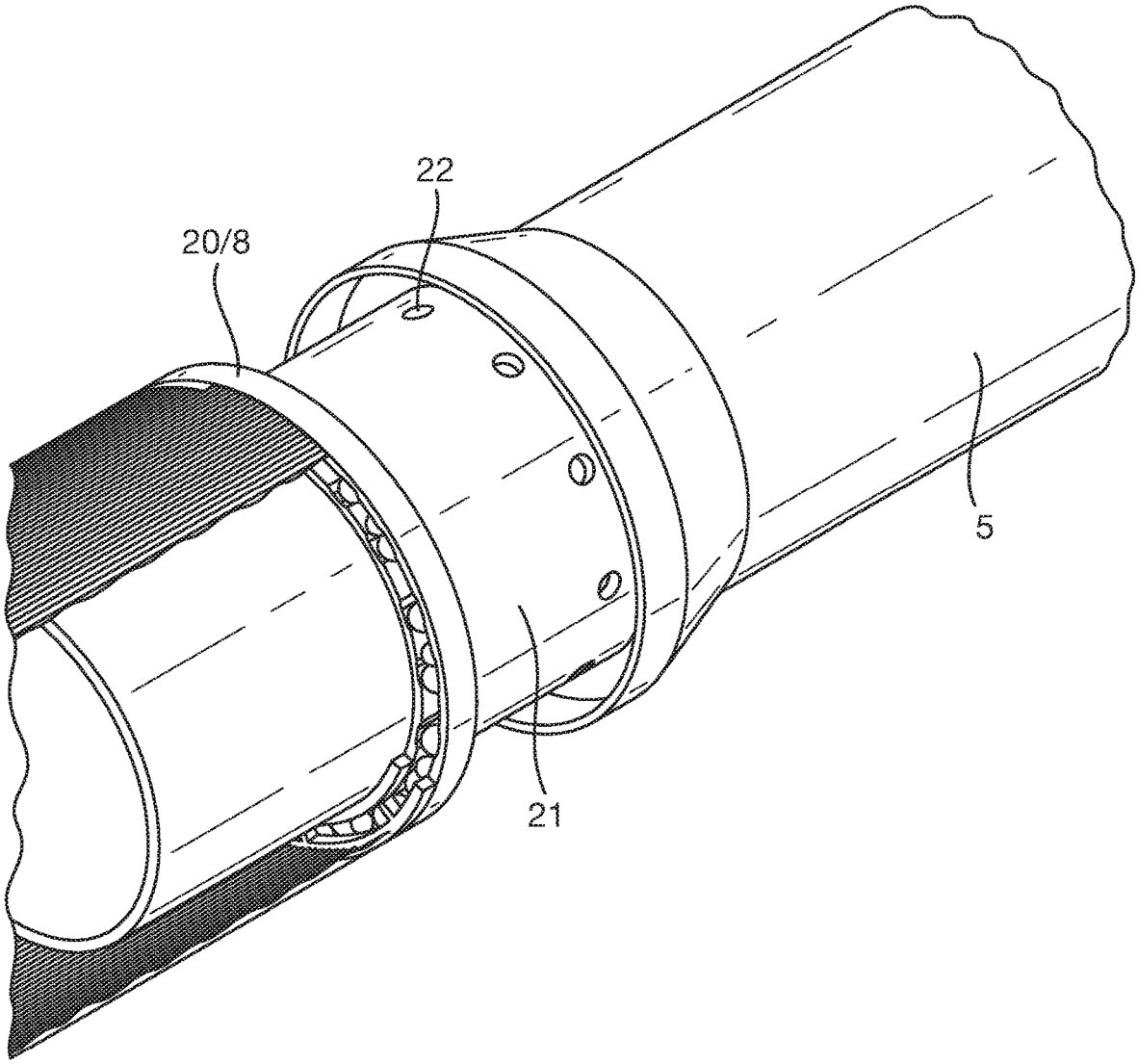
FIG. 11 is a schematic partly cutaway perspective view of the inflow assembly 20, which shows outlet from production chamber 21 into pipe string 5 through aperture 22 in pipe string 5.

FIG. 11 shows the inflow assembly 20 in a partly cutaway view where outlet 22 from the production chamber 21 in through the tubular string 5 is also shown.

Figure 12:
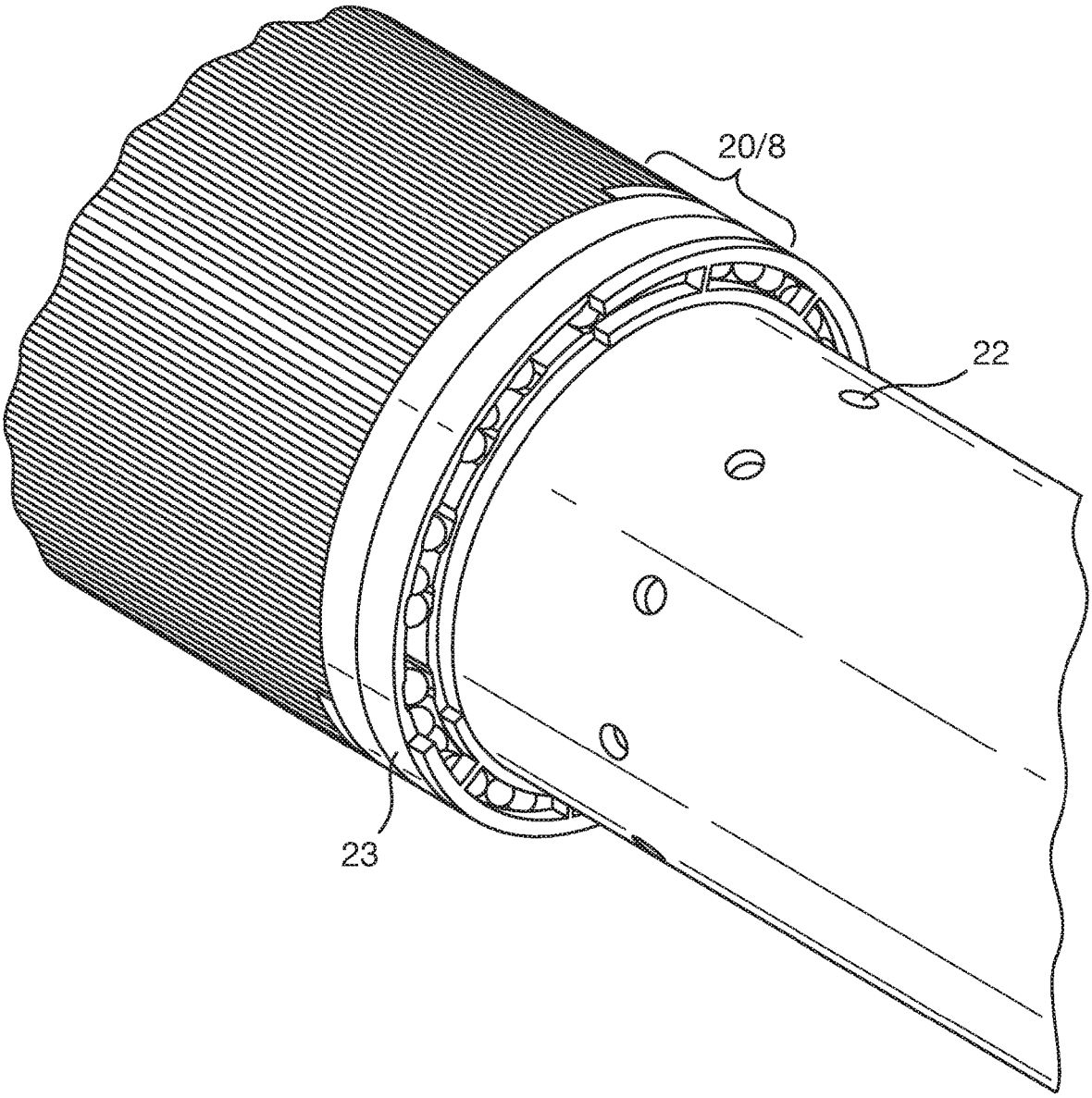
FIG. 12 is a schematic partly cutaway perspective view of the inflow assembly 20 with a combination of two inflow assemblies 20, one of which forms a backflow assembly 23 to prevent backflow of water into the reservoir.

FIG. 12 shows inflow assembly 20 in a partly cutaway view where a backflow assembly 23 has been added. This may be identical to the inflow assembly 20, but instead arranged such that it prevents water from falling back into the reservoir in the event of a halt in production. A backflow assembly 23 of this kind can be mounted together with the inflow assembly 20 according to the invention.

It is also not necessary for a particular element 7 to block the throughflow fully through a respective outlet aperture 9, as the element should instead be able to just increasingly restrict the flow through outlet aperture 9, if so desired. In an installation of this kind, bypass apertures through the inflow assembly 20 will have to be directed into outlet aperture 9 from chamber 8*c* in the inflow assembly 20, so as to prevent bypass fluid from moving past the flowback assembly 23, which does not have bypass aperture 10. Bypass fluid from aperture 10 in the inflow assembly 20 will in any case easily push any blocking elements in the backflow assembly free from their respective apertures 9, which correspond to apertures 9 in the inflow assembly 20. In this way, it will be possible to maintain the bypass function from the reservoir side, but block fluid from flowing back into the reservoir if it is of the undesired type.

Another advantageous embodiment is shown in FIG. 13 and is based on only one floating element that moves in chamber 8*c*. If chamber 8*c* is made curved, this will give an embodiment that is greatly simplified, but the advantage of the movable ceiling that provides a positive end stop just as the opening 9 is to be closed, is lost. For the embodiment in FIG. 13 to function, the suction from the well must hold the floating elements in place, and must slacken if desired fluid again enters the chamber 8*c*.

The bypass outlets 10 can, for example, be in the form of nozzles or other types of flow restrictors. The outlets 10 preferably have a greater restriction for flow therethrough compared with the outlets 9, for example, such that if the fluid contains a large proportion of gas, only a very limited flow through the bypass outlets 10 will be allowed. The outlets 9 can also typically be a form of nozzle that can be adjusted.

To prevent an excessive amount of gas or water from being produced from several zones, the fluid from different zones can be restricted on an individual zone basis by arranging more than one inflow assembly 20 along the tubular string 5. One or more inflow assemblies 20 can be used to control the flow of fluid from each corresponding zone. As a result, the well will produce an increased proportion of oil owing to the fact that the zones which produce excessive amounts of undesired well fractions are closed off or constantly choked by the inflow assembly 20.

It is further clear that the curved form of the individual chambers 8*c* with their elements 7, 6.1, 6.2 causes the inflow assembly to be independent of which way the pipe string ends up in the well. Up or down therefore loses its significance for the installation, all the shut-off chambers 8*c* will function as intended as long as outlet apertures from chambers are in the centre or almost in the centre of chamber 8*c*, and provided there is room in chamber 8*c* for the floating element 7 that is to block outlet aperture 9 to be located on both sides of the outlet aperture 9 in chamber 8*c*.

Furthermore, the inflow assembly in the present advantageous versions solves the problem of water that seeps back into the formation when there is a shutdown.

It can now be fully appreciated that the apparatus 20 in its different configurations described above is capable of achieving a number of desirable advantages in different situations. For example, when it is desirable to limit production of water from a gas well (that is, produce gas, but not water), the configurations in FIG. 2 will be used as the elements 7, 6.1, 6.2 each have a density that is almost equal to or less than that of water. In this way, the elements 7, 6.1, 6.2 will either have neutral buoyancy in water or will float on the surface of the water when the water enters the housing 8.*c*, and the elements will thus be carried by the water to the outlet aperture 9 and thereby restrict or prevent flow of the water into the tubular string 5.

As another example, when it is desirable to limit the production of gas from an oil well (that is, produce oil, but not gas), the configurations in FIG. 4 will be used as the elements 7, 6.1, 6.2 each have a density that is less than that of oil. In this way, the elements 7, 6.1, 6.1 will float on the oil or remain on the top in chamber 8.*c* 2 and away from outlet aperture 9 as shown in FIG. 4, where they will be located until a sufficient proportion of gas is produced to allow the elements 7, 6.1, 6.2 to sink down in the housing 8.*c* and close off (or at least to an increasing extent restrict) flow through outlet aperture 9. This will restrict or prevent flow of the gas into the pipe string 5.

It should be noted that the case of limiting the production of gas from an oil well is quite different from the case of limiting the production of water from a gas well. When limiting gas production from an oil well, the elements 7, 6.1, 6.2 are preferably not neutrally buoyant in the liquid phase (the oil), otherwise the members would be carried with the liquid flow to the outlet apertures 9. When the production of water from a gas well is limited, the elements 7 can be neutrally buoyant in the liquid phase (the water), since it is desirable that the members are carried with the liquid stream to outlet apertures 9 or to restrict the liquid flow into the pipe string 5.

As another example, when it is desirable to limit the production of gas and water from an oil well (that is, produce oil, but not gas or water), the configurations in FIGS. 2 and 4 could be combined to achieve this.

Thus, when the fluid contains undesired fluids (for example, water or sometimes gas), the restriction through the apparatus 20 increases. A major proportion of undesired fluids in the produced fluid results in a larger restriction for flow through the apparatus 20. The production from a zone that produces undesired fluids is thus reduced (because of the increased restriction through its corresponding apparatus 20), whilst production from other zones that produce several desired fluids is increased.

All floating elements 7, 6.1, 6.2 do not necessarily have the same density. It may be desirable instead that only the elements 7 have a number of different densities, and the elements 6.1 and 6.2 have a number of other densities, so that the elements have desired buoyancy in different fluid densities.

Of course, a person of skill in the art would, on careful consideration of the above description of representative embodiments of the invention, readily appreciate that many modifications, additions, substitutions, deletions, and other changes may be made to these specific embodiments, and such changes are within the scope of the principles of the present invention. Consequently, the foregoing detailed description is clearly to be understood as being given by way of illustration and example only, the spirit and scope of the present invention being limited solely by the appended claims and their equivalents.

Figure 14:
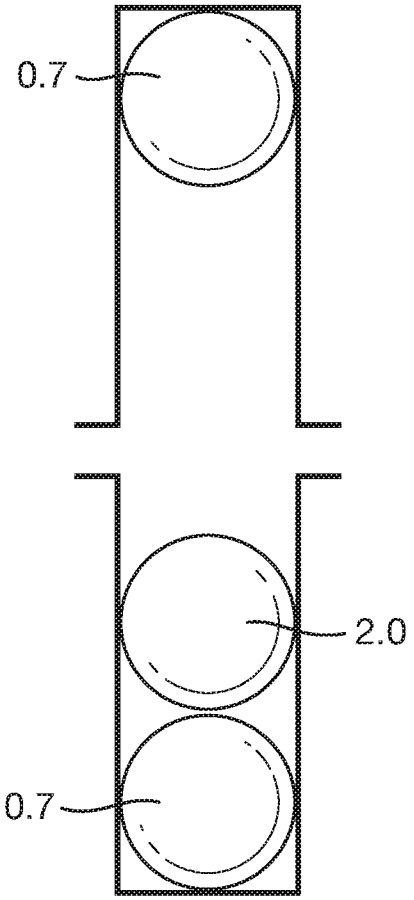
FIGS. 14 and 15 show an alternative embodiment for closing off gas.
Figure 15:
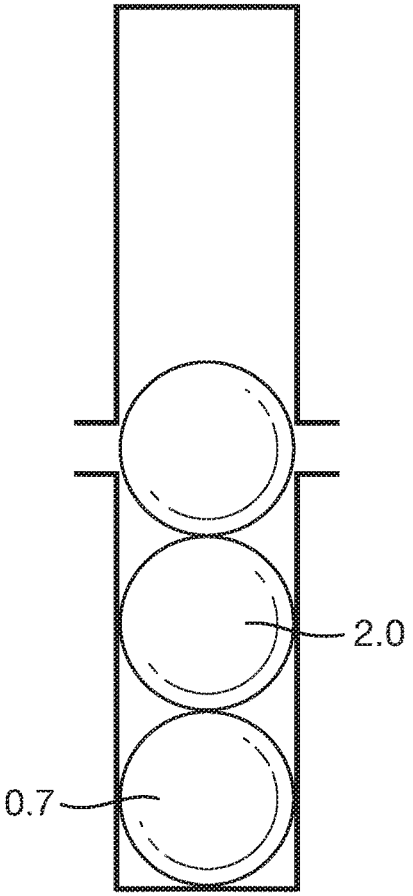

FIGS. 14 and 15 show an alternative embodiment of an inflow assembly for gas shut-off, where the ball in the middle is heavy (i.e., sinks) relative to the fluid it is desired to produce, whilst the balls on either side float in all desired fluid.

For example, gas enters and the ball on top sinks down as it does not float in gas. The heavy ball always sinks and holds the lowermost ball at the bottom so that it does not float up and close the outlet when there is oil in the system. If it is turned upside down or if a curved chamber is made, the inflow assembly will still work. The chamber does not need to be curved and can be in sections distributed around the circumference that is cylindrical, such that the same effect is obtained in all positions except a horizontal chamber that will be either open or closed.

Figure 16:
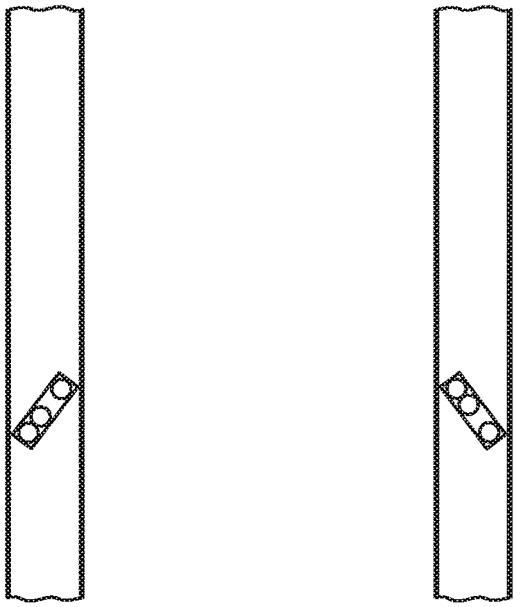
FIG. 16 shows an embodiment with inclined apertures.

If cylindrical holes are drilled at, for example, 45 degrees axially in towards the centre of the production tubing, ref. FIG. 16, none of the chambers will ever be able to lie horizontally either.

Two versions of the present invention are disclosed in the claims, one having at least three floating/sinking elements and another with at least one floating/sinking element. It should be understood that the different variants or alternative embodiments disclosed in the subsidiary claims could apply to both versions. It should also be understood that another number of floating elements could be used according to the invention.

The invention claimed is:

1. An inflow assembly for use in a subterranean well, wherein the inflow assembly is arranged to prevent one or more fractions of a produced medium from entering a production tubing, comprising:

at least one chamber extending along a non-horizontal axis and containing within the chamber at least three movable floating/sinking elements;

wherein the at least three movable floating/sinking elements comprise an upper movable element, a middle movable element, and a lower movable element, wherein the middle movable element is disposed between the upper movable element and the lower movable element;

wherein the at least one chamber includes an inlet opening facing in an inflow direction into the chamber, and an outlet aperture leading to the production tubing; and wherein the middle movable element has a higher density than a medium to be produced, while the upper movable element and the lower movable element has a lower density than the medium to be produced.

2. The inflow assembly of claim 1, wherein the inflow assembly is arranged for gas shut-off, wherein the upper movable element and the lower movable element have a lower density than gas, whereby the upper movable element or the lower movable element, depending on a vertical orientation of the inflow assembly, sinks and blocks the inlet opening and the outlet aperture.

3. The inflow assembly of claim 1, wherein the at least one chamber has a curved or straight shape.

4. The inflow assembly of claim 1, wherein the at least one chamber is arranged at an angle towards a center of the production tubing.

5. The inflow assembly of claim 4, wherein the at least one chamber is arranged at an angle of approximately 45 degrees towards the center of the production tubing.

* * * * *